US008394202B2

(12) United States Patent
Kulkarni

(10) Patent No.: US 8,394,202 B2
(45) Date of Patent: Mar. 12, 2013

(54) METHOD FOR MANUFACTURING SUGAR FROM SUGARCANE

(76) Inventor: Vishnukumar Mahadeo Kulkarni, Pune (IN)

( * ) Notice: Subject to any disclaimer, the term of this patent is extended or adjusted under 35 U.S.C. 154(b) by 302 days.

(21) Appl. No.: 12/672,634

(22) PCT Filed: Aug. 11, 2008

(86) PCT No.: PCT/IN2008/000501

§ 371 (c)(1),
(2), (4) Date: Feb. 8, 2010

(87) PCT Pub. No.: WO2009/066316

PCT Pub. Date: May 28, 2009

(65) Prior Publication Data

US 2011/0277751 A1 Nov. 17, 2011

(30) Foreign Application Priority Data

Aug. 18, 2007 (IN) ..... 754/MUM/2007
Apr. 17, 2008 (IN) ..... 868/MUM/2008

(51) Int. Cl.
*C13B 20/02* (2011.01)

(52) U.S. Cl. ..... 127/48

(58) Field of Classification Search ..... None
See application file for complete search history.

(56) References Cited

U.S. PATENT DOCUMENTS 3,694,262 A 9/1972 Casey
4,332,622 A 6/1982 Hohnerlein et al.
6,245,153 B1 6/2001 Gonzales
7,338,562 B2 * 3/2008 Dionisi et al. ..... 127/50
2011/0277751 A1 * 11/2011 Kulkarni ..... 127/48

FOREIGN PATENT DOCUMENTS

IN 190474 B * 8/2003
WO WO 01/14595 A2 3/2001

OTHER PUBLICATIONS

International Search Report, Mar. 11, 2009, from International Phase of the instant application.

* cited by examiner

*Primary Examiner* — Melvin C Mayes
*Assistant Examiner* — Stefanie Cohen
(74) *Attorney, Agent, or Firm* — Jackson Patent Law Office

(57) ABSTRACT

Disclosed is a method for manufacturing sugar from sugarcane. The method consists of steps of dosing biocides on sugarcane during cane preparation and milling to kill about 90% of microbes; heating juice, obtained from a mill to 70° C.; subsequently, neutralizing the juice; subsequent to the neutralizing step, heating the neutralized juice to about 105° C.; subsequent to the neutralizing step, passing the heated neutralized juice through clarifiers or settling tanks; concentrating the neutralized juice by evaporating to boil-off water from the neutralized juice to obtain syrup of the neutralized juice having about 60% solids; crystallizing the syrup, obtained in the concentrating step, to obtain a liquor; separating the sugar from the liquor obtained in the crystallizing step; and washing and drying the sugar obtained in the separating step. The sugar thus produced is about neutral and contains substantially zero amount of sulfur.

22 Claims, 2 Drawing Sheets

METHOD FOR MANUFACTURING SUGAR FROM SUGARCANE

FIELD OF THE INVENTION

The present invention relates to a process for manufacturing sugar from sugarcanes.

BACKGROUND OF THE INVENTION

In India, sugar is manufactured by a conventional double sulfitation process from sugarcane. FIG. 1 shows a flowchart of the double sulfitation process. The first step of the process includes steps of fibrillation of cane by passing canes through cane leveler, cutters, and fiberizers/shredders. This step is also known as cane preparation, which takes generally one minute to reach to further step.

In the second step, the prepared sugarcane is fed to cutter and then chopped and fed along with juice through a series of milling tandems (herein after referred to as mill). This step is known as milling where juice is extracted from the bagasse. Generally, milling comprises four or five mills in series. Normally, hot water is used in the last mill for maximum extraction of the juice from bagasse and juice collected is added in the previous mill. During milling, aqueous solutions of Chlorine, Iodine, Quaternary ammonium compounds, corbomate or dithiscorbonate based may be added for cane sanitation.

The juice obtained from mills is then passed through a series of juice heater for better reaction of juice with lime. In the 1$^{st}$ juice heater, juice is heated at about temperature of 70° C. However, heating of juice changes microbiology of the juice, where microbes having capacity to grow at a high temperature initiates their growth and microbes growing at normal temperature either die or remain in dormant stage till favorable conditions return.

The heated juice is then treated with milk of lime to raise pH above 9 or desired level to facilitate precipitation of inorganic impurities which is immediately followed by treatment with $SO_2$ gas released from sulfur burner in a sulfitation tower to reduce to a pH of juice to about 7.0 and decolorization. This is a FIRST SULFITATION step. Phosphoric acid may be added to the juice if sugarcane does not have sufficient phosphate content. The sulfited juice is passed through heater again to raise temperature to about 105° C. The heated juice is then sent to settling tank/clarifier (herein after referred to as Dorr settler). Flocculants and allied chemicals are added to promote flocculation and settling of mud and impurities in the Dorr settler. Juice overflowing from Dorr is clear and free from suspended impurities, which is then send through to series of evaporators to boil off water for further concentration to obtain concentrated juice of about 60% solids (brix) which is called as syrup. This syrup is again treated with $SO_2$ gas to decolorize the syrup and is sent to further concentration and crystallization in crystallizers and pans. This is SECOND SULFITATION step. This sulfated syrup has generally acidic pH about 5.0-5.5 and remaining process is thus carried with acidic pH. The liquor containing solid sugar from Pans dropped in centrifuge where sugar is separated from mother-liquor (molasses) by centrifugal force and is washed with steam and/or hot water. Sugar separated is the final product which is bagged after drying on through hoppers and silo. Petrochemical base or polymer base such as DOSS, NP10, surfactants as viscosity reducers may be used to reduce viscosity as a pan aid agent. This sugar contains sulfur dioxide, lead, conductivity ash, reducing sugar and moisture along with sucrose. The specifications of such plantation white sugar are as follows:

IS: 5982-2003 Requirements for Plantation White Sugar

| Characteristics | Requirement |
|---|---|
| Moisture, percent by mass, Max. | 0.10 |
| Sucrose, percent by weight, Min. | 99.5 |
| Reducing sugars, present by weight, Max. | 0.10 |
| Colour in ICUMSA units, Max. | 150 |
| Conductivity ash %, Max. | 0.1 |
| Sulphur dioxide, mg/kg Max. | 70 |
| Lead, ppm, Max. | 5.0 |

The sulfur treatment on juice and syrup is carried out mainly for decolorizing juice and syrup. The sulfur treatments along with mill sanitation as described above also help to reduce microbial activity. However, as sulfitation and mill sanitation only reduces microbial activity to certain extent and sugar loss due to microorganisms/microbes takes place during the process resulting in loss in the final yield of the sugar. Further, in the last stage of the process, syrup has an acidic pH which results in further loss of the sugar. Moreover, the sugar produced by this method contain significant amount of sulfur ($SO_2$) content i.e. 50-70 ppm, significant level of impurities and has acidic pH, therefore, not good for human health also. Furthermore, sugar produced by above double sulfitation process looses its color in storage as bleaching effect of sulfur ($SO_2$) reduces with time. Sugar with higher $SO_2$ and lower pH has limited keeping quality or in other words, quality of sugar deteriorates significantly during storage, that is, the sugar produced by this process has lower shelf life.

Further, day by day cost of Sulfur is also increasing resulting in the increasing the expenses of the double sulfitation process.

SUMMARY OF THE INVENTION

One of the main objects of the present invention is to provide a sugar manufacturing process to minimize or discontinue use of sulfur.

Further object of the present invention is to reduce the loss of sugar due to microbial activity.

Furthermore object of the present invention is to provide a sugar manufacturing process to reduce impurities in the sugar.

Further, another object of the present invention is to provide a process for manufacturing sugar to overcome shortcomings of the double sulfitation process.

The present invention provides a method for manufacturing sugar, which short-circuits at least one sulfitation step and utilizes means for minimizing microbe/microorganism activity.

The present invention provides a method for manufacturing sugar from sugarcane, comprising steps of dosing biocides on sugarcane during cane preparation and milling to kill about 90% microbes including microbes growing at high temperature; heating juice obtained from the mills at about 70 deg. C.; neutralizing the juice; heating the neutralized juice to about 105 deg C.; passing the heated juice through clarifiers or settling tanks; evaporating to boil-off water to obtain syrup of the juice having about 60% solids; crystallizing the syrup; and separating, washing and drying the sugar; wherein sugar produced is about neutral and contains substantially lower amount of sulfur.

In one embodiment, the neutralizing step of the method comprises step of mixing of the lime with the juice to neutralize the juice to produce sugar having substantially zero amount of sulfur.

In another embodiment, the neutralizing step includes raising pH of the juice to about 7.5-8.0 by mixing lime and mixing phosphoric acid and/or carbon dioxide ($CO_2$) and/or $SO_2$ to neutralize the alkaline juice to produce sugar having substantially less or zero amount of sulfur.

In further embodiment, the neutralizing step includes treating juice with milk of lime to raise pH above 9 or desired level to facilitate precipitation of inorganic impurities and neutralizing the alkaline juice with carbon dioxide ($CO_2$) to produce sugar having substantially zero amount of sulfur.

In one another embodiment, the neutralizing step includes treating juice with milk of lime to raise pH above 9 or desired level to facilitate precipitation of inorganic impurities and neutralizing the alkaline juice with sulfur dioxide ($SO_2$) to produce sugar having low amount of sulfur.

According to one embodiment of the present invention, the biocide sprayed or added during cane sanitation or mill sanitation is aqueous formulation of Formula I comprising: mixture of synergistically acting solutions of sodium and/or potassium salts of methyl,&/or dimethyl, &/or ethyl &/or cyanodiethyl dithiocarbamates about 25-50% w/w preferably 40±0.5% w/w, and 0 to 10 parts of foaming or non-foaming type dispersant/chelating agent formulated to kill about 90% microbes in ten minute. The Formula I biocide is preferably added in the milling step.

According to another embodiment, the biocide sprayed or added during cane sanitation or mill sanitation is aqueous formulation of Formula II comprising: mixture of synergistically acting solutions of sodium and/or potassium salts of methyl,&/or dimethyl, &/or ethyl &/or cyanodiethyl dithiocarbamates about 25-50% w/w preferably 40±0.5% w/w; one or in combination of amine based, polymer based, phosphate based, phosphonate based, organosulfur based, quinine based chelating/sequestrating/penetrating compound about 0.01 to 5% w/w; and 0 to 10 parts of foaming or non-foaming type dispersant/chelating agent formulated to kill about 90% microbes in one minute. The Formula II biocide is preferably added in the cane preparation step.

The present invention also provides amine polymer which may be added continuously, if necessary, to the juice or syrup for removal of impurities from sugar crystals at the time of crystallization in a quantity preferably 10 ppm and can vary from 2-20 ppm depending upon the quality of juice and/or syrup or to obtain desired quality of sugar. Also, if necessary, viscosity reducers such as various glycols, amines, acetates and/or non ionic polymer may be added continuously with suitable dilution to the syrup to reduce viscosity and improve crystallization and washing of sugar in centrifuge.

According to the present invention, viscosity reducers and flocculants may be added.

BRIEF DESCRIPTION OF THE DRAWINGS

Reference made to embodiments of the invention discussed above with objectives, examples of which may be illustrated in the accompanying figures. These figures are intended to be illustrative, not limiting. Although the embodiments of the invention are generally described in the context of these drawings, it should be understood that it is not intended to limit the scope of the embodiments of the invention to these drawings, in which.

DETAILED DESCRIPTION OF THE INVENTION

Various embodiments of this invention provide a method for manufacturing sugar from sugarcane. However, the embodiments are not limited and may be used in connection with various applications that will be described in later part of this specification.

In general, the present invention provides an improved method for manufacturing sugar which includes steps of spraying or adding or dosing biocides during cane preparation (calling as cane sanitation) and milling (calling as mill sanitation), short-circuiting at least one or both sulfitation steps of the conventional double sulfitation process and then treating sugarcane juice/syrup with two new formulations such as viscosity reducer and amine-based polymer for improving crystallization and for removing impurities, including decolorization of the sugar.

The present invention utilizes two biocide formulations, namely Formula I and Formula II, to kill the microbes during cane sanitation and mill sanitation step.

According to the present invention, the biocide of Formula I comprises mixture of synergistically acting solutions of sodium and/or potassium salts of methyl &/or dimethyl, &/or ethyl &/or cyanodiethyl dithiocarbamates about 25-50% w/w preferably 40±0.5% w/w, and 0 to 10 parts of foaming or non-foaming type dispersant/chelating agent formulated to kill about 90% microbes in ten minute.

According to the present invention, the biocide of Formula II comprises mixture of synergistically acting solutions of sodium and/or potassium salts of methyl,&/or dimethyl, &/or ethyl &/or cyanodiethyl dithiocarbamates about 25-50% w/w preferably 40±0.5% w/w; one or in combination of amine based, polymer based, phosphate based, phosphonate based, organosulfur based, quinine based chelating/sequestrating/penetrating compound about 0.01 to 5% w/w; and 0 to 10 parts of foaming or non-foaming type dispersant/chelating agent formulated to kill about 90% microbes in one minute.

Figure 1:
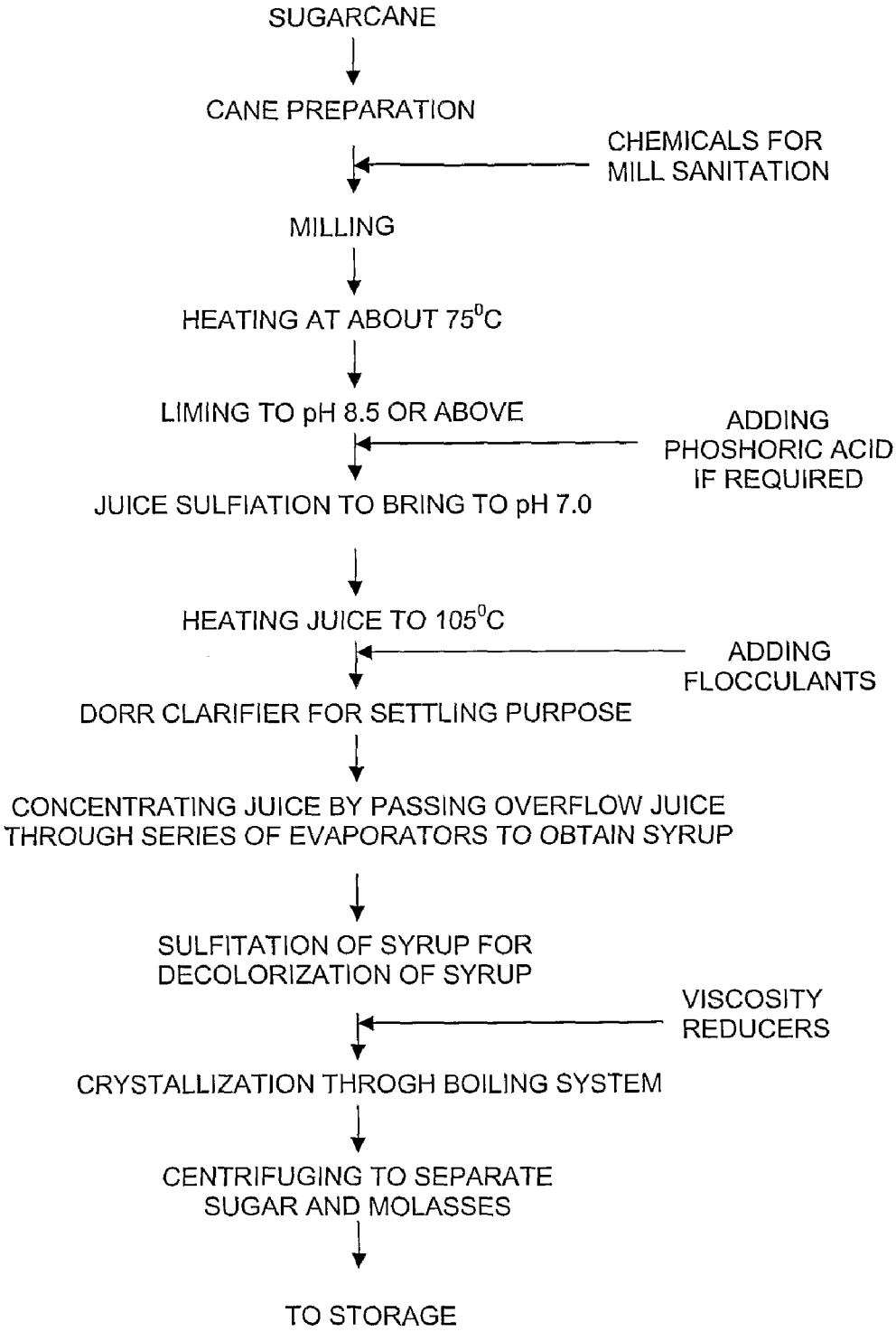
(PRIOR ART) Figure 1
FIG. 1 is a flowchart of conventional double sulfitation process.
Figure 2:
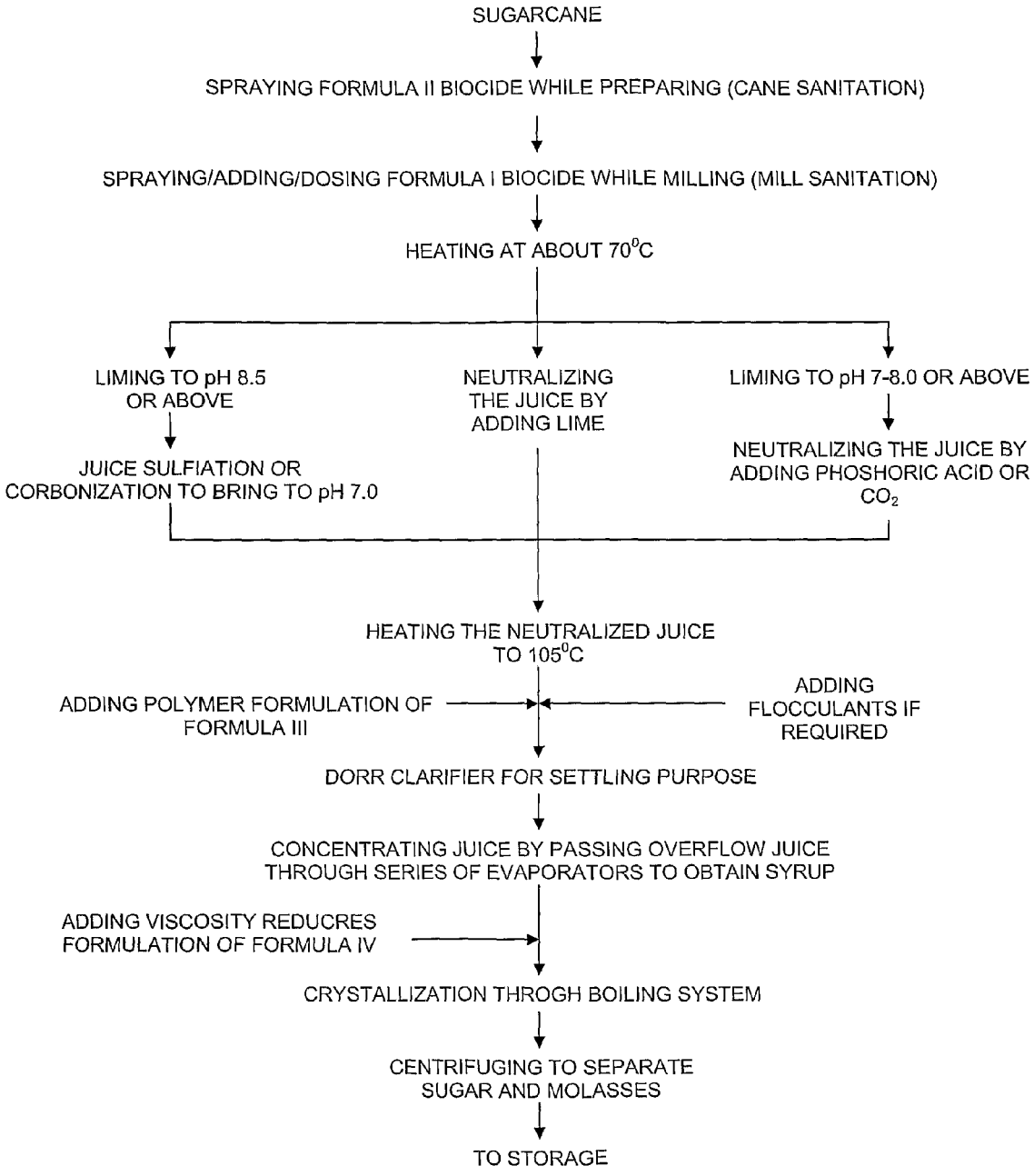
FIG. 2 is a flowchart of method according to the present invention.

FIG. 2 shows a flow chart of a method for manufacturing sugar from sugarcane according to the present invention.

As shown in FIG. 2, in the first step i.e. cane preparation, according to the present invention biocides of Formula II are sprayed on the sugarcane to kill about 90% microbes including microbes capable of growing at high temperature during cane sanitation in one minute. Alternatively, biocides of Formula I can be spread to kill the microbes. The spray of Formula II biocide can be done at one place or split into two or more places depending upon cane condition, length of the equipment and cane carrier and the like. Preferably, the biocide of Formula I is sprayed while leveling of the sugarcane for better effects of the biocides. Alternatively, biocide of Formula II can be spayed while passing the sugarcane through shredder or fibrillation. The biocide of Formula II sprayed during the cane preparation is preferably in the aqueous form. The quantity of spraying of Formula I biocide may vary from 1 ppm to 10 ppm individually or totally per kg of sugarcane depending upon the quality of the sugarcane and preferable quantity is 5 ppm on the sugarcane.

Then, in the milling step, the shredded and fibrillated cane is fed to mills to remove and extract juice from the cane wherein the biocides of Formula I is added to kill about 90% microbes including microbes capable of growing at high temperature in ten minute. In milling, the Formula I biocide is added or dosed in aqueous form and can be added in one of the mills or may be split into more places or in juice collecting tanks or the last two or three mills for mill sanitation. The adding or dosing of the biocide of the Formula I depends upon cane quality and environmental factor such as temperature, humidity, rainfall during harvesting/crushing. Generally, the total dose may vary from 1 ppm to 20 ppm and preferable dose is 10 ppm.

As shown in FIG. 2, the juice obtained from the mill sanitation is heated at about 70° C. and then neutralized.

According to the first embodiment to the invention, juice can be neutralized by mixing of the lime with the juice i.e. adding lime to neutralize the acidic juice.

In the second embodiment of the present invention, juice can be neutralized by initially raising pH of the juice to about 7.5-8.0 by mixing lime and then mixing phosphoric acid and/or $CO_2$ to neutralize the alkaline juice.

In the third embodiment, according to the present invention the juice can be neutralized by treating the juice first with milk of lime to raise pH above 8 or at desired level and neutralizing the alkaline juice with $SO_2$ by using sulfur burner.

According to the forth embodiment of the present invention, $CO_2$ gas can be used in the third embodiment to neutralize the alkaline juice instead of $SO_2$ to avoid sulfur content in the final product.

As shown in FIG. 2, the neutralized juice obtained from one of the embodiments of the present invention is heated to about 105° C. and then is passed through the Dorr clarifiers to remove impurities. The flocculating agents can be added in the Dorr clarifier to increase rate of settling of impurities, unwanted solids and the like. The overflow from the Dorr clarifies is then passed through the series of evaporators to boil off water for further concentration to obtain syrup having about 60% solids. Afterward, the syrup is fed to the crystallizers and pans to obtain sugar which is then separated from mother-liquor, washed with steam or hot water, dried and filled in Silo or bags.

The present invention provides amine polymer of formula III that can be added continuously, if necessary, to the juice and/or syrup for removal of impurities from sugar crystals at the time of crystallization. The total dose of the Formula III varies from 2-20 ppm and preferable dose is 10 ppm.

Formula III is aqueous solution of polymer active matter of 20 to 60% preferably 45% made by reacting coco di-methyl amine/alkyl amine with epi-chlorohydrine in a reaction vessel. The process consists steps of adding 10-40 parts of coco di-methyl or alkyl amine with continuous stirring, cooling and adding 8 to 42 parts of epi-chlorohydrine slowly to carry out reaction between 25-60 deg C., and then transferring the milky white reaction mixture in air tight containers and allowing reaction mixture to become a translucent viscous liquid. Other agents such as color precipitants and/or flocculants may be added depending on the requirement.

The present invention also provides a chemical formulation of Formula IV comprising various glycols, amines, acetates and/or non ionic polymer in predetermined ratio that may be added continuously with suitable dilution, if necessary, to the syrup as viscosity reducer so as to achieve reduced viscosity of syrup, which would favor better and faster crystallization. The dose of the viscosity reducer may vary from 1 ppm to 20 ppm depending on the viscosity of the syrup and recommended dose is 5 ppm.

Formula IV viscosity reducer consists of at least:

| | |
|---|---|
| Glycol fatty acid ester | 5 to 20 parts |
| Polyglycerol fatty acid ester | 5 to 20 parts |
| Sorbitin monoester | 5 to 20 parts |
| Ammonium acetate | 0.5 to 5 parts |
| Non ionic surfactant | 2.5 to 12.5 parts |
| Quaternery ammonium compound | 0.1 to 5 parts |
| Water | qs to make 100 parts |

The sugar produced using process of the present invention has microbial-count less than 200 cfu per 10 gm of sugar and lower impurities such as dextran, calcium, conductivity ash. Further, sugar also has acceptable lower color and lower moisture.

The neutralizing processes described in first, second and forth embodiments completely eliminate use of the $SO_2$ i.e. eliminate sulfitation process leading into zero percent of sulfur in the final product.

The neutralizing process describes in the third embodiment avoids use of the $SO_2$ treatment of syrup in second stage, thereby resulting significant reduction in sulfur content in the sugar. This process can be called as single sulfitation process.

Sugar manufactured by above mentioned process has pH of sugar about neutral and improved shelf life. Sugar obtained by the present invention is beneficial for health-conscious people because of its unique features, namely, the extremely low microbial count and negligible or zero sulfur content. Further, impurities like conductivity ash, dextran, calcium, reducing sugar etc are less in the sugar produced by present invention than that of by conventional invention.

EXAMPLES

The present invention will now be further explained in the following examples. However, the present invention should not be construed as limited thereby. One of ordinary skill in art will understand how to vary the exemplified preparation to obtain the desired results.

Example 1

The method described in third embodiment is carried out at Kisanveer Satara Sahaksri Sakhar Karkhana Ltd., Bhuinj as an experiment. The quantity of raw material used is as follows:

| Raw Material | Quantity |
|---|---|
| Sugar cane | 4500 MT |
| Biocide Of Formula I | 22.5 kg |
| Biocide of Formula II | 45 kg |
| Amine polymer of formula III | 45 kg |
| Viscosity Reducer formula IV | 45 kg |

As against the specifications results achieved by this process, the sugar was sent for analysis to Maarc Labs, Pune (an ISO 17025 lab accredited by NABL). The results are as follows:

Color: >100 IU typical 87 IU by method 8 and 60 IU by method 10

Calcium: 18 ppm (mg/kg)

Conductivity ash: 0.0145%

Dextran: >40 ppm

Microbial count: 120 cfu per 10 g $SO_2$ content: >2 ppm

Moisture: 0.0156% pH: 6.6

Example 2

The method described in first embodiment is carried out at Kisanveer Satara Sahakari Sakhar Kharkhana Ltd., Bhuinj as an experiment. The quantities of raw material used are as follows:

| Raw Material | Quantity |
|---|---|
| Sugar cane | 4500 MT |
| Biocide Of Formula I | 22.5 kg |
| Biocide of Formula II | 45 kg |
| Amine polymer of formula III | 45 kg |
| Viscosity Reducer formula IV | 45 kg |

The sugar produced was sent to United Sugar Company, Saudi Arabia for analysis. As against the specifications results achieved by this process are as follows:

| Analysis | Uom | Sample-1 | Sample-2 (with dust) | Method |
|---|---|---|---|---|
| Pol | ° Z | 99.86 | 99.79 | GS 1/2/3-1 |
| Colour | IU | 187 | 180 | GS 1/3-7 |
| Ash (Conductivity method) | % | 0.024 | 0.023 | GS 1/3/4/7/8-13 |
| Reducing Sugars | % | 0.012 | 0.014 | GS 1/3/7-3 |
| Starch (By Plews Method) | mg/kg | 113 | 95 | Plews |
| Dextran | mg/kg | <20 | <20 | GS 1-15 |
| Filterability | — | 1.44 | 1.43 | USC |
| Moisture (Loss on drying at 105° C.) | % | 0.027 | 0.045 | GS 2/1/3-15 |
| Turbidity | IU | 10.7 | 11.3 | GS7-21 |
| Sediment | mg/kg | 69 | 80 | GS 2/3-19 |
| $SO_2$ content | Ppm | 0 | 0 | |

CONCLUSION

The sugar produced by single sulfitation process contains less amount of sulfur i.e. less than 2 ppm and sugar produced by a process without sulfitation contain negligible amount of sulfur.

While the present invention has been disclosed in connection with certain embodiments, this description should not be taken as limiting the invention to all of the provided details. Modifications and verifications of the described embodiments may be made without departing from the scope and spirit of the invention. Various multiple alternate embodiments are encompassed in the present invention disclosure would be understood by one of ordinary skill in the art. The scope of the invention is to be limited only by the following claims:

The invention claimed is:

1. A method for manufacturing sugar from sugarcane, the method consisting of steps of:

dosing biocides on sugarcane during cane preparation and milling to kill about 90% of microbes;

heating juice, obtained from a mill, to 70° C.;

subsequently, neutralizing the juice;

subsequent to the neutralizing step, heating the neutralized juice to about 105° C.;

subsequent to the neutralizing step, passing the heated neutralized juice through clarifiers or settling tanks;

concentrating the neutralized juice by evaporating to boil-off water from the neutralized juice to obtain syrup of the neutralized juice having about 60% solids;

crystallizing the syrup, obtained in the concentrating step, to obtain a liquor;

separating sugar from the liquor obtained in the crystallizing step; and washing and drying the sugar obtained in the separating step;

whereby the sugar produced is about neutral and contain substantially zero amount of sulfur.

2. A method as claimed in claim 1 wherein the neutralizing step comprises mixing lime in the juice to neutralize the juice to produce sugar having zero amount of sulfur.

3. A method as claimed in claim 1 wherein the neutralizing step comprises raising pH of the juice to about 7.5-8.0 by mixing lime and mixing phosphoric acid and/or carbon dioxide ($CO_2$) and/or $SO_2$ to neutralize the alkaline juice to produce sugar having substantially zero amount of sulfur.

4. A method as claimed in claim 1 wherein the neutralizing step comprises treating juice with milk of lime to raise pH above 8 or desired level to facilitate precipitation of inorganic impurities and neutralizing the alkaline juice with carbon dioxide ($CO_2$) to produce sugar having substantially zero amount of sulfur.

5. A method as claimed in claim 1 wherein the neutralizing step comprises treating juice with milk of lime to raise pH above 8 to facilitate precipitation of inorganic impurities and neutralizing the alkaline juice with sulfur dioxide ($SO_2$) to produce sugar having substantially zero amount of sulfur.

6. A method as claimed in claim 1 wherein dosing biocides during cane preparation includes spraying the biocides in the cane preparation before leveling of the sugarcane or before passing sugarcane through a the shredder and/or chopper.

7. A method as claimed in claim 1 wherein dosing biocides during milling includes adding the biocides in one of the mills or in juice collecting tanks.

8. A method as claimed in claim 1 wherein biocide dosed during mill sanitation or cane sanitation is aqueous formulation of Formula I comprising:

a. mixture of synergistically acting solutions of sodium and/or potassium salts of methyl, &/or dimethyl, &/or ethyl &/or cyanodiethyl dithiocarbamates about 25-50% w/w and b. 0 to 10 parts of foaming or non-foaming type dispersant/chelating agent formulated to kill about 90% microbes in ten minute.

9. A method as claimed in claim 8 wherein biocide of Formula I is dosed in a plurality of places.

10. A method as claimed in claim 1 wherein dose of said biocide can be vary from 1 ppm to 20 ppm (mg per kg of cane).

11. A method as claimed in claim 1 wherein the biocides dosed is aqueous formulation of Formula II comprising:

a. mixture of synergistically acting solutions of sodium and/or potassium salts of methyl, &/or dimethyl, &/or ethyl &/or cyanodiethyl dithiocarbamates about 25-50% w/w;

b. one or in combination of amine based, polymer based, phosphate based, phosphonate based; organosulfur based, quinine based chelating/sequestrating/penetrating compound about 0.01 to 5% w/w; and c. 0 to 10 parts of foaming or non-foaming type dispersant/chelating agent formulated to kill about 90% microbes in one minute.

12. A method as claimed in claim 11 wherein biocide of Formula II is sprayed for cane sanitation on prepared sugarcane or leveling the sugarcane before shredder/fiberizer cane during cane preparation.

13. A method as claimed in claim 12 wherein dose of said Formula II biocide can be vary from 1 ppm to 15 ppm per kg of the sugarcane depending upon cane quality.

14. A method as claimed in claim 1 wherein amine polymer can be added continuously, if necessary, to the juice and/or syrup for removal of impurities from sugar crystals at the time of crystallization in a quantity from 2-20 ppm depending upon the quality of juice and/or syrup or to obtain desired quality of sugar.

15. A method as claimed in claim 1 wherein viscosity reducers can be added continuously with suitable dilution, if necessary, to the syrup to reduce viscosity and improve crystallization and washing of sugar in centrifuge.

16. A method as claimed in claim 1 wherein flocculants can be added in the clarifiers for the settling of solids.

17. A method for manufacturing sugar from sugarcane, the method consisting of steps of:

dosing biocides on sugarcane during cane preparation for cane sanitation and milling for mill sanitation;

heating the juice at 70° C.;

subsequently, neutralizing the juice;

subsequent to the neutralizing step, heating the neutralized juice to about 105° C.;

subsequent to the neutralizing step, adding amine polymers in the neutralized juice to effect solid settling;

concentrating the neutralized juice by evaporating to boil off water to obtain syrup of the neutralized juice having about 60% solids;

crystallizing the syrup, obtained in the concentrating step, to obtain a liquor; and separating sugar from the liquor obtained in the crystallizing step; and washing and drying the sugar;

whereby a sulfitation step is short-circuited to produce sugar containing substantially zero amount of sulfur.

18. A method as claimed in claim 17, wherein amine polymer added is of Formula III comprising aqueous solution of polymer active matter of 20 to 60% made by reacting coco di-methyl amine/alkyl amine with epi-chlorohydrine.

19. A method as claimed in claim 17, wherein total dose of the polymer formulation of Formula III varies from 2-20 ppm.

20. A method for manufacturing sugar from sugarcane, the method consisting of steps of:

dosing biocides on sugarcane during cane preparation for cane sanitation and milling for mill sanitation;

heating the juice to 70° C.;

subsequently, neutralizing the juice;

subsequent to the neutralizing step, heating the neutralized juice to about 105° C.;

subsequent to the neutralizing step, passing the neutralized juice through clarifiers or settling tanks;

concentrating the neutralized juice by evaporating to boil-off water to obtain syrup of the neutralized juice having about 60% solids;

adding viscosity reducers to reduce viscosity of the syrup;

crystallizing the syrup, obtained in the concentrating step, to obtain a liquor; and separating sugar from the liquor obtained in the crystallizing step; and washing and drying the sugar;

whereby a sulfitation step is short-circuited to produce sugar containing substantially zero amount of sulfur.

21. A method as claimed in claim 20 wherein dose of the viscosity reducer may vary from 1 ppm to 20 ppm depending on the viscosity of the syrup.

22. A method as claimed in claim 20 wherein viscosity reducer added is of Formula IV comprising Glycol fatty acid ester: 5 to 20 parts;

Polyglycerol fatty acid ester: 5 to 20 parts;

Sorbitin monoester: 5 to 20 parts;

Ammonium acetate: 0.5 to 5 parts;

Non ionic surfactant: 2.5 to 12.5 parts;

Quaternery ammonium compound: 0.1 to 5 parts;

Water: Qs to make 100 parts.

* * * * *